US005637550A

United States Patent [19]

Leenders et al.

[11] Patent Number: 5,637,550

[45] Date of Patent: Jun. 10, 1997

[54] HEAT-SENSITIVE RECORDING MATERIAL HAVING IMAGE-STABILIZATION PROPERTIES

[75] Inventors: Luc Leenders, Herentals; Leo Oelbrandt, Kruibeke, both of Belgium

[73] Assignee: Agfa-Gevaert N.V., Mortsel, Belgium

[21] Appl. No.: 597,429

[22] Filed: Feb. 8, 1996

[30] Foreign Application Priority Data

Mar. 2, 1995 [EP] European Pat. Off. ..... 95200506

[51] Int. Cl.[6] ..... B41M 5/32

[52] U.S. Cl. ..... 503/209; 430/338; 430/567; 430/609; 430/619; 430/945; 503/202; 503/210

[58] Field of Search ..... 430/338, 567, 430/608, 619, 945; 503/202, 210, 209; 427/150–152

[56] References Cited

U.S. PATENT DOCUMENTS

| | | | |
|---|---|---|---|
| 3,094,417 | 6/1963 | Workman | 503/210 |
| 3,094,619 | 6/1963 | Grant | 503/210 |
| 3,218,166 | 11/1965 | Reitter | 503/210 |
| 3,526,506 | 9/1970 | Workman | 503/210 |
| 5,514,636 | 5/1996 | Takeuchi | 503/207 |

FOREIGN PATENT DOCUMENTS

| | | | |
|---|---|---|---|
| 2168370 | 8/1973 | France | 503/210 |
| 2010822 | 10/1970 | Germany | 430/200 |
| 59-041294 | 3/1984 | Japan | 430/200 |
| 1271177 | 4/1972 | United Kingdom | 503/202 |

*Primary Examiner*—Bruce H. Hess
*Attorney, Agent, or Firm*—Brumbaugh, Graves, Donohue & Raymond

[57] ABSTRACT

A heat-sensitive recording material suited for use in direct thermal imaging and having image-stabilization properties which material contains in a binder on a support (i) a substantially light-insensitive organic silver salt capable of thermally activated reduction to silver in thermal working relationship with (ii) at least one reducing agent capable of reducing the substantially light-insensitive organic silver salt when thermally activated, characterized in that the recording material contains in conjunction, preferably in admixture, with the reducing agent(s) at least one colourless photo-oxidizing substance that on exposure to ultraviolet (UV) radiation, such as present in daylight or artificial lighting, yields free radicals capable of inactivating said reducing agent(s) by oxidation, thereby rendering said reducing agent(s) incapable of reducing said organic silver salt to silver.

18 Claims, No Drawings

HEAT-SENSITIVE RECORDING MATERIAL HAVING IMAGE-STABILIZATION PROPERTIES

DESCRIPTION

1. Field of the Invention

The present invention relates to a heat-sensitive recording material being suited for use in direct thermal imaging and having image-stabilization properties.

2. Background of the Invention

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.

2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye layer wherefrom dyed portions or incorporated dye is transferred onto a contacting receiver element by the application of heat in a pattern normally controlled by electronic information signals. A survey of "direct thermal" imaging methods is given in the book "Imaging Systems" by K. I. and R. E. Jacobson, Focal Press, London (1976), Chapter VII under the heading "7.1 Thermography". Thermography is concerned with materials which are not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

A wide variety of chemical systems has been suggested some examples of which have been given on page 138 of "Imaging Systems" by K. I. and R. E. Jacobson, Focal Press, London (1976). One interesting thermographic system capable of providing images having an optical density more than 2.5 is based on the production of a silver metal image by means of a thermally induced oxidation-reduction reaction of a silver soap with a reducing agent. U.S. Pat. No. 3,094,417 describes a typical heat-sensitive copy-sheet product capable of undergoing permanent visible change on being momentarily heated to a conversion temperature between about 90° C. and about 150° C. and comprising a heat-sensitive layer containing chemically inter-reactant components in physically distinct and chemically inter-reactive relationship for inter-reaction to form a visibly distinct reaction product on heating said layer to said conversion temperature, one of said inter-reactant components being readily desensitizable against said inter-reaction by exposurer in solution in an inert solvent at a concentration just sufficient to permit distinctly visible reaction with the other of said components in said solvent, to radiation in the near-ultraviolet range of approximately 3000 to 4200 angstroms wavelength as obtained from a BH-6 high pressure mercury arc lamp at a distance of 6 inches and for a time of 45 minute, and, uniformly intermixed with said one component, a colored activatable organic photoreducible dye characterized by its ability to cause reduction of silver ion in a dilute solution of silver nitrate, triethanolaramonium nitrater and said dye on exposure of said solution for thirty minutes to visible light absorbable by said dye and at about 60,000 foot-candles intensity as obtained from a high intensity incandescent tungsten filament lamp. Furthermore, according to U.S. Pat. No. 3,094,417, the chemically inter-reactive components to form a visibly distict reaction product on heating may be silver behenate and 4-methoxy-1-naphthol (a reducing agent) and the inter-reactant component being readily desensitizable against inter-reaction by exposure may be a mild reducing agent present in relatively high concentration.

Desensitization of a redox-system of light-insensitive organic silver salt and organic reducing agent, optionally in the presence of a toning agent with "the activatable silver-reducing organic dyes" described in U.S. Pat. No. 3,094,417 has the disadvantage of introducing background colour dyes by definition exhibiting colour in the visible spectrum, into the image obtained by direct thermal heating and also some increase in background due to the photo-activatable silver ion reducing properties of these dyes, as described in U.S. Pat. No. 3,094,417.

GB-P 1,271,177 concerns hexaarylbiimidazole compositions and to a method for oxidizing certain oxidizable compounds and more particularly admixtures of a hexaarylbiimidazole and selected oxidizable compositions together with a method for activating, by means of heat, pressure, light or electron beam, the hexaarylbiimidazole which, in its activated free radical state, oxidizes the oxidizable composition with a formal oxidation potential of 1.35 volts or less relative to a standard calomel electrode and being selected from p-arylenedi tertiaryamines, p-phenylenediamines, p-tolylenediamines, hydrazones, N-acylhydrazones, o,o'-disubstituted phenols and organic sulfhydryl compounds.

In order to provide recording materials containing a redox-system of light-insensitive organic silver salt and organic reducing agent, the problem of avoidance of thermal background colouration and archival image-preservation should be solved in such a way that the material is not additionally coloured.

OBJECTS OF THE INVENTION

It is an object of the present invention to provide a thermally activatable redox system capable of producing a silver image suitable for direct thermal imaging and having image-stabilization properties for preventing the formation of background fog or colouration after thermal imaging, without intoducing additional colouration into the image.

It is a further object of the present invention to provide a thermal recording process operating with thermally activatable redox systems capable of producing a silver image that after imagewise heating can be stabilized against further action of heat without intoducing additional colouration into the image.

Other objects and advantages of the present invention will appear from the following description and examples.

SUMMARY OF THE INVENTION

In accordance with the present invention a heat-sensitive recording material suited for use in direct thermal imaging and having image-stabilization properties is provided which material containing in a binder on a support (i).a substantially light-insensitive organic silver salt capable of thermally activated reduction to silver in thermal working relationship with (ii) at least one reducing agent capable of reducing the substantially light-insensitive organic silver salt when thermally activated, characterized in that the recording material contains in admixture with the reducing agent(s) at least one colourless photo-oxidizing substance that on exposure to ultraviolet (UV) radiation, such as present in daylight or artificial lighting, yields free radicals capable of inactivating the reducing agent(s) by oxidation, thereby rendering the reducing agent(s) incapable of reducing the organic silver salt to silver.

A thermographic process according to the present invention comprises the steps of:

(1) providing a recording material containing on a support in a binder (1) a substantially light-insensitive organic silver salt capable of yielding a coloured substance by thermally activated reduction, and in thermal working relationship therewith (ii) at least one reducing agent capable of reducing the substantially light-insensitive organic silver salt when thermally activated and in admixture with the reducing agent(s) at least one colourless photo-oxidizing substance that on exposure to ultraviolet (UV) radiation, such as present in daylight or artificial lighting, yields free radicals capable of inactivating the reducing agent(s) by oxidation; (2) bringing the recording material into contact with a heat source; (3) heating the recording material imagewise pixel by pixel; (4) separating the recording material from the heat source; and (5) uniformly exposing the imagewise heated recording material to ultraviolet radiation activating the photo-oxidizing substance to effect the oxidation of residual reducing agent.

By "thermal working relationship" is meant here that the substantially light-insensitive compound, e.g. a substantially light-insensitive silver salt, and the organic reducing agent can react when the recording material is heated, i.e. at elevated temperature, to form e.g. metallic silver. For that purpose the ingredients (i) and (ii) may be present in the same binder-containing layer or in different layers wherefrom by heat they can come into reactive contact with each other, e.g. by diffusion.

The colourless photo-oxidizing substances of the present invention that on exposure to ultraviolet (UV) radiation, such as present in daylight or artificial lighting, yield free radicals capable of inactivating the reducing agent(s) by oxidation are not capable of reducing silver ions in a dilute solution of silver nitrate, triethanolammonium nitrate upon exposure for thirty minutes to light absorbable by the substance at about 60,000 foot-candles intensity as obtained from a high intensity incandescent tungsten filament lamp.

DETAILED DESCRIPTION OF THE INVENTION

In a preferred embodiment the heat-sensitive recording material according to the present invention contains as colourless photo-oxidizing substance a bi-imidazolyl compound that on photo-exposure following thermal imaging can yield free radicals having the capability of oxidizing the reducing agent(s) that remain after thermal imaging thereby making them inactive for further reduction of the silver salt. It is surprising that such bi-imidazolyl compounds, upon photo-activation, are able to oxidize the same reducing agents which are efficient in the thermally activated reduction of substantially light-insensitive silver salts.

Two imidazolyl radicals, that are capable of abstracting active hydrogen, so-called Zerewitinoff hydrogen, from the organic reducing agent(s) left in the non-heated areas of the present direct thermal recording material, are formed from bi-imidazolyl compounds by photo-cleavage.

Colourless photo-oxidizing bi-imidazolyl compounds suited for use according to the present invention correspond to following general formula:

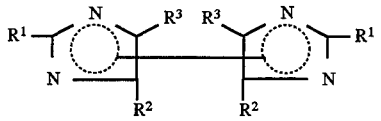

wherein:

each of $R^1$, $R^2$ and $R^3$ (same or different) stands for a carbocyclic or heterocyclic aromatic group, said group being free from Zerewitinoff hydrogen atoms and each dotted line circle representing 4 delocalized electrons. Zerewitinoff hydrogen atoms, as well known, are active hydrogen atoms that are capable of reacting with methylmagnesiumiodide. The preparation of several such bi-imidazolyl compounds are described in U.S. Pat. No. 3,734,733 and GB-P 1,271,177.

The bimidazolyl compounds may correspond to one of the following isomeric structures:

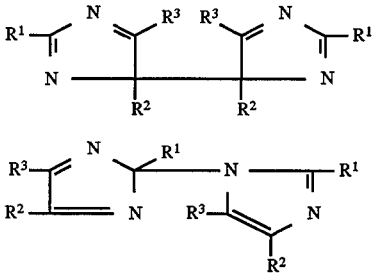

wherein:

$R^1$, $R^2$ and $R^3$ have the same meaning as described above, preferably are aromatic groups, e.g. a phenyl, biphenyl, naphthyl, furyl or thienyl group, or such groups in substituted form, e.g. substituted with halogen, or $R^1$, $R^2$ and $R^3$ represent a heteroaromatic saltlike system (IV) as described in published EP 0 355 335, wherein reference is made to the preparation of such type of compounds.

In order to suppress the formation of background fog the biimidazolyl compound(s) are used advantageously in the heat-sensitive recording material in a molar ratio from 2:1 to 250:1 with respect to the applied reducing agent(s).

Preferably the biimidazolyl compounds are applied at a coverage of 0.5 to 2 g/m$^2$, but the amount can be adapted according to the required stabilization that prevents the formation of background fog.

The bi-imidazolyl compounds are inherently sensitive to ultraviolet radiation in the wavelength range of 250 nm to 370 nm ["Imaging Systems", K. I. and R. E. Jacobson, Focal Press, London (1976), p.249].

According to another embodiment of the present invention the colourless photo-oxidizing substance yielding on exposure to UV-radiation oxidizing free radicals is a haloalkane, e.g. carbon tetrabromide, iodoform or a halosulphone, e.g. tribromomethyl-phenylsulphone. Such substances are described in "Imaging Systems", K. I. and R. E. Jacobson, Focal Press, London (1976), p. 223–225.

From said haloalkanes on exposure to UV radiation bromine or iodine free radicals are formed that have oxidizing power to inactivate organic reducing agents by abstraction thereof of active hydrogen.

Organic Reducing Agents

Organic reducing compounds suitable for use according to the present invention have at least one active hydrogen atom and are exemplified in the already mentioned U.S. Pat. No. 3,734,733 and belong to one of the following classes:

(1) aromatic polyhydroxyl compounds and oxidizable derivatives, e.g. aromatic polyhydroxyl compounds, optionally containing a free or esterified carboxylic acid group, and wherein one of the hydroxyl groups may be substituted with an alkoxy group, e.g. catechol, gallic acid and ethyl gallate;

(2) aromatic polyamino compounds and their oxidizable derivatives, e.g. N-alkyl-substituted derivatives;

(3) organic hydroxylamino compounds and oxidizable derivatives thereof;

(4) compounds according to the following general formula:

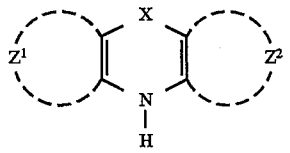

wherein:

X represents oxygen, sulphur, —NH—, —$CH_2$—, —CH=CH— or C=O, and each of $Z^1$ and $Z^2$ (same or different) represents the necessary atoms to close a carbocyclic aromatic ring e.g. benzene ring including a substituted benzene ring.

A survey of conventional organic reducing agents containing active hydrogen attached through O, N or C is given e.g. in GB-P 1,439,478.

Particularly suited thermo-activatable reducing agents for use in combination with non-lightsensitive reducible organic silver salts are aromatic polyhydroxy spiro-bis-indane compounds, especially those disclosed in published European patent application 0 599 369, more particularly 3,3,3',3'-tetramethyl-5,6,5'6'-tetrahydroxy-1,1'-spiro-bis-indane, called further on "indane I".

Other reducing agents particularly suited for use according to the present invention are organic hydroxylamine compounds corresponding to the following general formula (F):

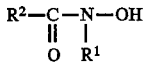

wherein:

$R^1$ represents hydrogen, an aliphatic group or a cycloaliphatic group, e.g. an alkyl group containing up to four carbon atoms, and $R^2$ represents an alkoxy group, e.g. an alkoxy group containing up to 18 carbon, an aryloxy group, or an amino group of the following formula:

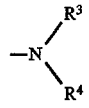

in which:

each of $R^3$ and $R^4$ (same or different) represents hydrogen, an aliphatic group or an aromatic group, or $R^3$ and $R^4$ represent together the necessary atoms to close a 5- or 6-membered heterocyclic nitrogen containing ring, e.g. piperidinyl ring.

Reducing agents according to the above general formula (F) and their preparation are described in Re. 30,107 being a reissue of U.S. Pat. No. 3,996,397.

Still other reducing agents particularly suited for use according to the present invention are 3,4-dihydroxybenzenes in which the benzene nucleus carries in the 1-position a substituent linked to said nucleus by means of a carbonyl group.

Preferred "carbonyl" substituted 3,4-dihydroxy-benzene reducing agents for use according to the present invention are less volatile than catechol and are selected from the group consisting of 3,4-dihydroxy-benzoic acid, an alkyl or aryl ester thereof, 3,4-dihydroxy-benzaldehyde, 3,4-dihydroxy-benzamide and aryl or alkyl (3,4-dihydroxyphenyl) ketones. The alkyl esters of 3,4-dihydroxy-benzoic acid comprise e.g. from 1 to 18 carbon atoms, but are preferably C1-C4 alkyl esters.

Further are advantageously used according to the present invention reducing agents that itself are decomposed by ultra-violet radiation contain a group having the following structure:

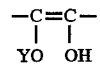

or contain a group having the following structure:

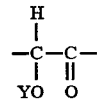

wherein: Y represents a hydrogen atom or an acyl group.

Reducing agents containing that structure are described in GB-P 1,163,187 for use in a photo-thermographic recording material containing light-sensitive silver halide in the presence of a light-insensitive reducible organic silver salt.

Auxiliary Reducing Agents

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive silver salt such as silver behenate, or are bisphenols, e.g. of the type described in U.S. Pat. No. 3,547,648. The auxiliary reducing agents may be present in the imaging layer or in a polymeric binder layer adjacent thereto.

Preferred auxiliary reducing agents are sulfonamidophenols corresponding to the following general formula:

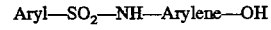

in which:

Aryl represents a monovalent aromatic group, and

Arylene represents a bivalent aromatic group, having the —OH group preferably in para-position to the —$SO_2$—NH— group.

Sulfonamidophenols according to the above defined general formula are described in the periodical Research Disclosure, February 1979, item 17842, in U.S. Pat. Nos. 4,360,581 and 4,782,004, and in published European Patent Application No. 423 891, wherein these reducing agents are mentioned for use in a photo-thermographic recording material in which photo-sensitive silver halide is present in catalytic proximity to a substantially light-insensitive silver salt of an organic acid.

Other auxiliary reducing agents that may be used in conjunction with the above mentioned primary reducing agents are organic reducing metal salts, e.g. stannous stearate described in U.S. Pat. Nos. 3,460,946 and 3,547,648.

Organic Silver Salts

Substantially light-insensitive organic silver salts particularly suited for use in a direct thermal recording process according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

The silver image density depends on the coverage of said substantially light-insensitive silver salts in combination with the above mentioned reducing agent(s) and has to be preferably such that, on heating above 100° C., an optical density of at least 2.5 can be obtained.

The thickness of the imaging layer is preferably in the range of 5 to 50 μm.

According to a special embodiment said substantially light-insensitive organic silver salt and said organic reducing agent(s) are present in different layers. The reducing agent can e.g. migrate by heat into the layer containing the organic silver salt and react therewith. The reducing agent(s) is (are) applied preferably in the layer containing the photo-oxidizing agent.

Binders

The film-forming polymeric binder of the imaging layer of the direct thermal recording material used according to the present invention is preferably a water-insoluble thermoplastic resin or mixture of such resins, wherein the silver salt can be dispersed homogeneously. For that purpose all kinds of natural, modified natural or synthetic water-insoluble resins may be used, e.g. cellulose derivatives such as ethylcellulose, cellulose esters, e.g. cellulose nitrate, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonltrile and acrylamide, polyacrylic acid esters, polymethacrylic acid esters and polyethylene or mixtures thereof.

A particularly suitable polyvinyl butyral containing a minor amount of vinyl alcohol units is marketed under the tradename BUTVAR™ B79 of Monsanto USA and provides a good adherence to paper and properly subbed polyester supports.

The layer containing the organic silver salt is commonly coated from an organic solvent containing the binder in dissolved form.

The continuous tone reproduction capability of a heat-sensitive imaging material used according to the present invention is favoured by a relatively high binder to silver salt weight ratio in the imaging layer. Preferably said ratio is in the range of 1/2 to 6/1, and more preferably from 1/1 to 4/1.

The binder of the imaging layer may be combined with waxes or "heat solvents" also called "thermal solvents" or "thermosolvents" improving the reaction speed of the redox-reaction at elevated temperature or serving as liquid medium for the diffusion of the reducing agents in intimate contact with the organic reducible substantially light-insensitive silver salt.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959. Still other examples of heat solvents have been described in U.S. Pat. Nos. 3,438,776, and 4,740,446, and in published EP-A 0 119 615 and 0 122 512 and DE-A 3 339 810.

Toning Agents

In order to further correct for deficiencies in neutrality of image toner i.e. to come still closer to perfect black in the higher densities and neutral grey in the lower densities the recording layer contains in admixture with said organic silver salt and reducing agents a so-called toning agent known from thermography or photo-thermography oprating with reducible silver salts.

Suitable toning agents are phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are succinimides and the heterocyclic toner compounds of the benzoxazine dione or naphthoxazine dione type within the scope of following general formula:

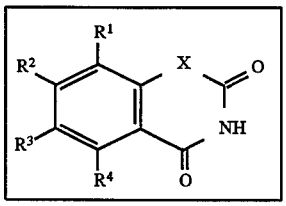

in which:

X represents O or N-alkyl;

each of $R^1$, $R^2$, $R^3$ and $R^4$ (same or different) represents hydrogen, alkyl, e.g. C1-C20 alkyl, preferably C1-C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyalohexane ring. Toners within the scope of said general formula are described in GB-P 1,439,478 and U.S. Pat. No. 3,951,660.

A toner compound particularly suited for use in combination with the above mentioned 3,4-dihydroxy benzene reducing agents is benzo[e] [1,3] oxazine-2,4-dione described in U.S. Pat. No. 3,951,660.

Other Ingredients

In addition to said ingredients the imaging layer may contain other additives such as free fatty acids, antistatic agents, e.g. non-ionic antistatic agents including a fluorocarbon group as e.g. in $F_3C(CF_2)_6CONH(CH_2CH_2O)$—H, ultraviolet light absorbing compounds, white light reflecting and/or ultraviolet radiation reflecting pigments, and/or optical brightening agents.

Substrate

The substrate also called support for the heat-sensitive imaging layer of the thermosensitive recording material used according to the present invention is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if need be to improve the adherence to the thereon coated heat-sensitive imaging layer.

Applications

Direct thermal imaging can be used for both the production of transparencies and reflection type prints. Such means that the support may be transparent or opaque, e.g. the support has a white light reflecting aspect. For example, a paper base is used which may contain white light reflecting pigments, optionally also applied in an interlayer between the recording layer and said base. In case a transparent base is used, said base may be colourless or coloured, e.g. has a blue colour.

In the hard copy field recording materials on white opaque base are used, whereas in the medical diagnostic field black-imaged transparencies find wide application in inspection techniques operating with a light box.

Processing

The imagewise heating of the recording material according to the present invention may proceed by heat transferred imagewise from a contacting original absorbing infrared radiation in its image markings. According to more recent techniques heat is applied imagewise by one of the following embodiments.

In a first embodiment of the method according to the present invention the pattern-wise or imagewise heating of the recording material proceeds electrically by means of a thermal head containing an array of electrically activated micro-resistors. The heating is based on the Joule effect in that selectively energized electrical resistors of a thermal head array are used in contact or close proximity with the recording layer of the thermosensitive recording material.

In a special embodiment of image-wise electrically heating the recording material, an electrically resistive ribbon is used consisting e.g. of a multilayered structure of a carbon-loaded polycarbonate coated with a thin aluminium film (ref. Progress in Basic Principles of Imaging Systems - Proceedings of the International Congress of Photographic Science Köln (Cologne), 1986 ed. by Friedrich Granzer and Erik Moisar - Friedr. Vieweg & Sohn - Braunschweig/Wiesbaden, FIG. 6. p. 622). Current is injected into the resistive ribbon by electrically addressing a print head electrode contacting the carbon-loaded substrate, thus resulting in highly localized heating of the ribbon beneath the energized electrode. In the present embodiment the aluminium film makes direct contact with the heat-sensitive recording layer or its protective outermost layer.

The fact that in using a resistive ribbon heat is generated directly in the resistive ribbon and only the travelling ribbon gets hot (not the print heads) an inherent advantage in printing speed is obtained. In applying the thermal printing head technology the various elements of the thermal printing head get hot and must cool down before the head can print without cross-talk in a next position.

In a second embodiment of the method according to the present invention the recording layer of said recording material is heated image-wise or pattern-wise by means of a modulated laser beam. For example, image-wise modulated laser light is used to heat the recording layer image-wise by means of substances converting absorbed laser light, e.g. infrared radiation into heat. In said embodiment the recording layer or a layer in intimate thermo-conductive contact therewith contains light-into-heat converting substances, e.g. infrared radiation absorbing substances.

The imagewise applied laser light has not necessarily to be infrared light since the power of a laser in the visible light range and even in the ultraviolet region can be thus high that sufficient heat is generated on absorption of the laser light in the recording material. There is no limitation on the kind of laser used which may be a gas laser, gas ion laser, e.g. argon ion laser, solid state laser, e.g. Nd:YAG laser, dye laser or semi-conductor laser.

The use of an infrared light emitting laser and a dye-donor element containing an infrared light absorbing material is described e.g. in U.S. Pat. No. 4,912,083. Suitable infra-red light absorbing dyes for laser-induced thermal dye transfer are described e.g. in U.S. Pat. No. 4,948,777, which U.S. patent documents for said dyes and applied lasers have to be read in conjunction herewith.

In a third embodiment the image- or pattern-wise wise heating of the recording material proceeds by means of pixel wise modulated ultra-sound, using e.g. an ultrasonic pixel printer as described e.g. in U.S. Pat. No. 4,908,631.

The image signals for modulating the ultrasonic pixel printer, laser beam or electrode current are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Direct thermal imaging can be used for both the production of transparencies and reflection type prints. Such means that the support will be transparent or opaque, e.g. having a white light reflecting aspect. For example, a paper base is present which may contain white light reflecting pigments, optionally also applied in an interlayer between the recording layer and said base. In case a transparent base is used, said base may be colourless or coloured, e.g. has a blue colour.

In the hard copy field recording materials on white opaque base are used, whereas in the medical diagnostic field black-imaged transparencies find wide application in inspection techniques operating with a light box.

The recording materials of the present invention are particularly suited for use in thermographic recording techniques operating with thermal print-heads. Suitable thermal printing heads are e.g. a Fujitsu Thermal Head (FTP-040 MCS001), a TDK Thermal Head F415 HH7-1089, and a Rohm Thermal Head KE 2008-F3.

Protection of recording layer

In a particular embodiment in order to avoid direct contact of the printheads with the recording layer that has not been provided with an outermost protective layer, the imagewise heating of the recording layer with said printheads proceeds through a contacting but removable resin sheet or web wherefrom during said heating no transfer of imaging material can take place.

In an other embodiment in order to avoid local deformation of the recording layer, to improve resistance against abrasion and in order to avoid the direct contact of the printheads with the recording layer a protective coating is applied thereto. Such coating may have the same composition as an anti-sticking coating or slipping layer which is applied in thermal dye transfer materials at the rear side of the dye donor material.

A slipping layer being said outermost layer may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$-$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layer compositions are described in e.g. EP 138483, EP 227090, U.S. Pat. No. 4,567,113, U.S. Pat. No. 4,572,860, U.S. Pat. No. 4,717,711 and EP-A 311 841.

A suitable slipping layer being here an outermost layer at the recording layer side comprises as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Another suitable outermost slipping layer may be obtained by coating a solution of at least one silicon compound and a substance capable of forming during the coating procedure a polymer having an inorganic backbone which is an oxide of a group IVa or IVb element as described EP-A 554 583.

Other suitable protective layer compositions that may be applied as slipping (anti-stick) coating are described e.g. EP-A's 0 501 072 and 0 492 411.

The support for the heat-sensitive recording material according to the present invention is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if need be to improve the adherence to the thereon coated heat-sensitive recording layer.

Coating Techniques

The coating of the heat-sensitive recording layer and protective layer if applied may proceed by any coating technique e.g. as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

The following examples illustrate the present invention. The percentages and ratios are by weight unless otherwise indicated.

INVENTION EXAMPLE 1 AND COMPARATIVE EXAMPLE 1

A thermographic recording material according to the present invention is prepared and tested as described hereinafter. A subbed polyethylene terephthalate support having a thickness of 100 μm was doctor blade-coated from a solution in methyl ethyl ketone to obtain after drying the following recording layer A containing:

| | |
|---|---|
| silver behenate | 7.73 g/m$^2$ |
| polyvinyl butyral | 3.78 g/m$^2$ |
| reducing agent R as defined hereinafter | 2.95 g/m$^2$ |
| "indane I" as main reducing agent | 0.06 g/m$^2$ |
| benzo[e][1,3]oxazine-2,4-dione | 0.85 g/m$^2$ |
| bis(2,4,5-triphenyl-imidazole) | 3.66 g/m$^2$ |
| silicone oil | 0.02 g/m$^2$ |

The non-invention recording layer B had the same composition as invention recording with the difference however that it was free from bis(2,4,5-triphenyl-imidazole).

Both recording materials A and B were used in a thermal printer MITSUBISHI CP100 wherein the printing proceeded while having the printing head in contact with one side of a 5 μm thick polyethylene terephthalate web (blanco web), the other side of said web being in contact with the recording layer.

The optical densities of the thermally imaged ($D_{max}$) and non-imaged ($D_{min}$) areas were measured in transmission with densitometer Macbeth TD 904 provided with an ortho filter (maximal transmission at about 500 nm). These optical densities are given in Table 2.

After said thermal printing and optical density measurement the recording layers A and B were overall exposed with a 2000 W high-pressure mercury vapour lamp doped with $FeCl_3$, and non-imaged areas were subjected to printing as described hereinbefore.

Minimum ($D_{min}$) and maximum ($D_{max}$) optical densities of the recording materials A and B in the newly printed zone were measured and the results are listed also in the following Table 2.

TABLE 2

| | Before UV-exposure | | After UV-exposure | |
|---|---|---|---|---|
| Recording material | $D_{min}$ | $D_{max}$ | $D_{min}$ | $D_{max}$ |
| A, Comp. example 1 | 0.07 | 2.50 | 0.07 | 0.50 |
| B, Invention example 1 | 0.07 | 2.50 | 0.07 | 2.50 |

From the $D_{min}$ results in said Table can be derived that with the combination of reducing agents and colourless photo-oxidizing agent used in a recording material A according to the present invention a strong reduction in thermosensitivity can be obtained by UV-exposure without increasing the $D_{min}$-value due to colouration from the stabilizing agent.

Structure of "auxiliary" reducing agent R:

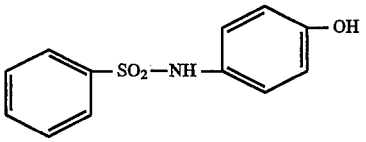

INVENTION EXAMPLE 2

The preparation of recording material C was the same as for recording material A with the difference however, that recording layer C had the following composition:

| | |
|---|---|
| silver behenate | 7.73 g/m$^2$ |
| polyvinyl butyral | 3.78 g/m$^2$ |
| auxiliary reducing agent R | 2.95 g/m$^2$ |
| main reductor M as defined hereinafter | 0.19 g/m$^2$ |
| benzo[e][1,3]oxazine-2,4-dione | 0.85 g/m$^2$ |
| bis(2,4,5-triphenyl-imidazole) | 3.66 g/m$^2$ |
| silicone oil | 0.02 g/m$^2$ |

The recording material C was used likewise in a thermal printer MITSUBISHI CP100 wherein the printing proceeded while having the printing head in contact with one side of a 5 μm thick polyethylene terephthalate web (blanco web), the other side of said web being in contact with the recording layer.

The optical densities of the imaged ($D_{max}$) and non-imaged ($D_{min}$) areas were measured in transmission with densitometer Macbeth TD 904 provided with an ortho filter (maximal transmission at about 500 nm).

After printing and measuring the optical density the recording layer C was overall exposed with a 2000 W high-pressure mercury vapour lamp doped with $FeCl_3$, and non-imaged areas were subjected to printing as described hereinbefore.

Minimum ($D_{min}$) and maximum ($D_{max}$) optical densities of the recording material C in the newly printed zone were measured and are listed also in the following Table 3.

TABLE 3

| | Before UV-exposure | | After UV-exposure | |
|---|---|---|---|---|
| Recording material | $D_{min}$ | $D_{max}$ | $D_{min}$ | $D_{max}$ |
| C, Invention example 2 | 0.05 | 2.20 | 0.10 | 1.05 |

Structure of "main" reductor M:

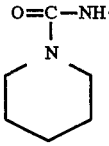

We claim:

1. A heat-sensitive recording material suited for use in direct thermal imaging and having image-stabilization properties which material contains in a binder on a support (i) a substantially light-insensitive organic silver salt capable of thermally activated reduction to silver in thermal working relationship with (ii) at least one reducing agent capable of reducing said substantially light-insensitive organic silver salt when thermally activated, characterized in that said recording material contains in admixture with said reducing agent(s) at least one colourless photo-oxidizing substance that on exposure to ultraviolet (UV) radiation yields free radicals capable of inactivating said reducing agent(s) by oxidation, thereby rendering said reducing agent(s) incapable of reducing said organic silver salt to silver.

2. Recording material according to claim 1, wherein said colourless photo-oxidizing substance is a bi-imidazolyl compound.

3. Recording material according to claim 2, wherein said bi-imidazolyl compound(s) are present in a molar ration from 2:1 to 250:1 with respect to the applied reducing agent(s).

4. Recording material according to claim 1, wherein said colorless photo-oxidizing substance is a bi-imidazolyl compound wherefrom by photo-cleavage two imidazolyl radicals are formed that are capable of abstracting active Zerewitinoff hydrogen from said reducing agent(s).

5. Recording material according to claim 1, wherein said colorless photo-oxidizing substance corresponds to following general formula:

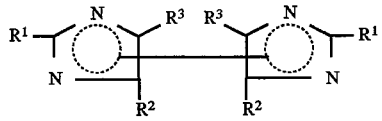

wherein:

each of $R^1$, $R^2$ and $R^3$, which can be the same or different, stands for a carbocyclic or heterocyclic aromatic ring group, said group being free from Zerewitinoff hydrogen atoms and each dotted line circle representing 4 delocalized electrons.

6. Recording material according to claim 1, wherein said substantially light-insensitive organic silver salt is a silver salt of an aliphatic carboxylic acid having at least 12 C-atoms.

7. Recording material according to claim 6, wherein said organic silver salt is silver palmitate, silver stearate or silver behenate or mixtures thereof.

8. Recording material according to claim 1, wherein said recording layer contains at least one toning agent for metallic silver formed by reduction of said organic silver salt.

9. A thermographic process comprising the steps of: (1) providing a recording material containing on a support in a binder (i) a substantially light-insensitive organic silver salt capable of yielding a coloured substance by thermally activated reduction, and in thermal working relationship therewith (ii) at least one reducing agent capable of reducing said substantially light-insensitive organic silver salt when thermally activated and in admixture with said reducing agent(s) at least one photo-oxidizing substance that on exposure to ultraviolet radiation yields free radicals capable of inactivating said reducing agent(s) by oxidation; (2) bringing said recording material into contact with a heat source; (3) heating said recording material imagewise pixel by pixel; (4) separating said recording material from said heat source; and (5) uniformly exposing said imagewise heated recording material to ultraviolet radiation activating said photo-oxidizing substance to effect the oxidation of residual reducing agent.

10. Thermographic process according to claim 9, wherein said image-wise heating proceeds electrically by means of a thermal head containing an array of electrically activated micro-resistors.

11. Recording process according to claim 9, wherein said image-wise heating proceeds by means of a modulated laser beam the absorbed radiation of which is converted into heat by substances present in said recording material.

12. Recording process according to claim 9, wherein said colourless photo-oxidizing substance is a bi-imidazolyl compound.

13. Recording process according to claim 12, wherein said colorless photo-oxidizing substance is a bi-imidazolyl compound wherefrom by photo-cleavage two imidazolyl radicals are formed that are capable of abstracting active Zerewitinoff hydrogen from said reducing agent(s).

14. Recording material according to claim 12, wherein said bi-imidazolyl compound(s) are present in a molar ration from 2:1 to 250:1 with respect to the applied reducing agent(s).

15. Recording process according to claim 9, wherein said colorless photo-oxidizing substance corresponds to following general formula:

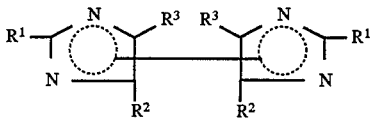

wherein:

each of $R^1$, $R^2$ and $R^3$, which can be the same or different, stands for a carbocyclic or heterocyclic aromatic ring group, said group being free from Zerewitinoff hydrogen atoms and each dotted line circle representing 4 delocalized electrons.

16. Recording material according to claim 9, wherein said substantially light-insensitive organic silver salt is a silver salt of an aliphatic carboxylic acid having at least 12 C-atoms.

17. Recording material according to claim 16, wherein said organic silver salt is silver palmitate, silver stearate or silver behenate or mixtures thereof.

18. Recording process according to claim 9, wherein said recording layer contains at least one toning agent for metallic silver formed by reduction of said organic silver salt.

* * * * *